US005168194A

United States Patent [19]

Littlechild et al.

[11] Patent Number: 5,168,194

[45] Date of Patent: Dec. 1, 1992

[54] PULSE SIMMER FLASH LAMP CATHODE

[75] Inventors: David H. Littlechild, Oakington; Bernard R. Venn, Great Shelford, both of Great Britain

[73] Assignee: Heraeus Noblelight Limited, Cambridge, England

[21] Appl. No.: 754,189

[22] Filed: Aug. 28, 1991

Related U.S. Application Data

[63] Continuation of Ser. No. 412,174, Sep. 25, 1989, abandoned, which is a continuation-in-part of Ser. No. 126,491, Nov. 30, 1987, abandoned.

[30] Foreign Application Priority Data

Dec. 2, 1986 [GB] United Kingdom ..... 8628806
Apr. 29, 1987 [GB] United Kingdom ..... 8710112

[51] Int. Cl.[5] ..... H01J 17/28; H01J 61/04; H01J 61/52

[52] U.S. Cl. ..... 313/632; 313/23; 313/42; 362/373

[58] Field of Search ..... 313/37, 39, 42, 47, 313/336, 631, 632, 23; 362/373; 165/104.33

[56] References Cited

U.S. PATENT DOCUMENTS 2,682,006 6/1954 Ferrari, Jr. ..... 313/23 X
3,248,586 4/1966 Schlegel ..... 313/632 X
3,930,176 12/1975 Panico ..... 313/42 X
4,734,835 3/1988 Vines et al. ..... 362/373 X

*Primary Examiner*—Sandra L. O'Shea
*Attorney, Agent, or Firm*—Oblon, Spivak, McClelland, Maier & Neustadt

[57] ABSTRACT

A flash light operating in the "pulse and simmer" mode has a cathode and an anode 18 mounted at opposite ends of a transparent envelope 10. The cathode, which may be water cooled, includes a mount 24 and a tip 26 joined to the mount by an undercut neck portion 28. Thus the tip 26 runs at an increased operational temperature due to the reduced thermal conductivity of the neck portion. The ratio of the diameter D of the tip 26 to its axial dimension C from the neck portion 28 may be in the range 0.3 to 0.5.

12 Claims, 3 Drawing Sheets

Figure 3:
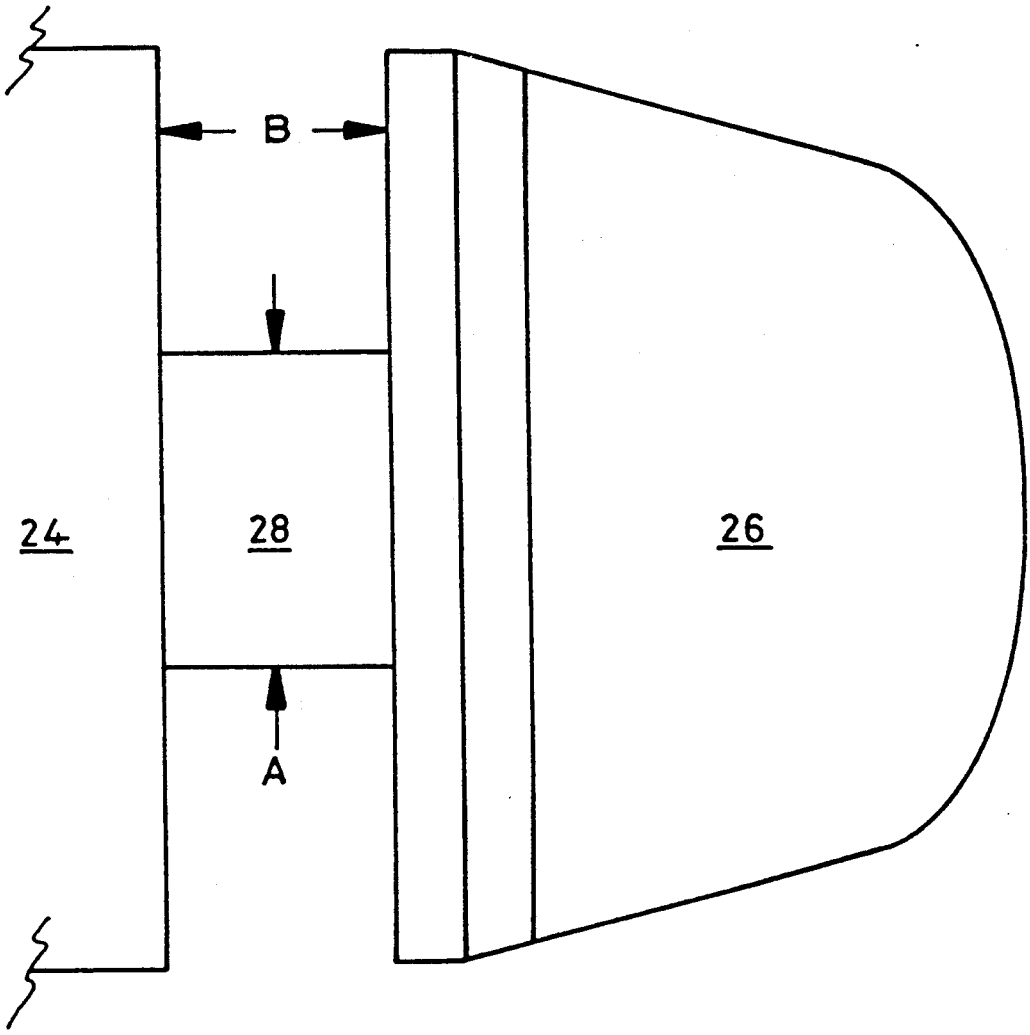

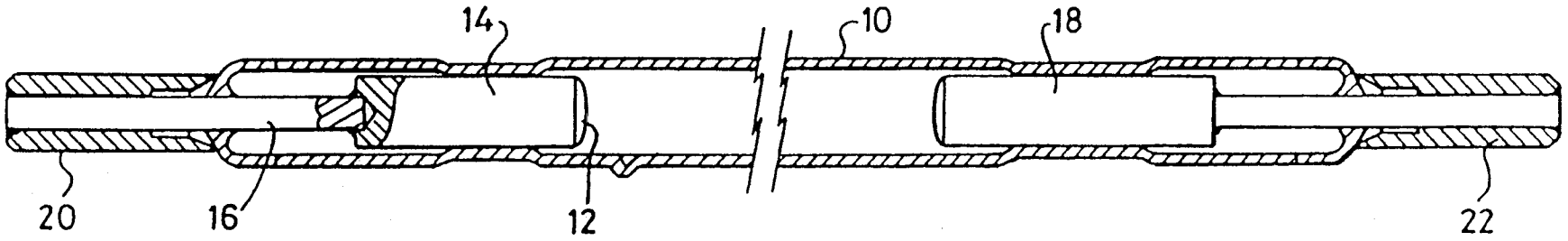
Fig. 1 - PRIOR ART
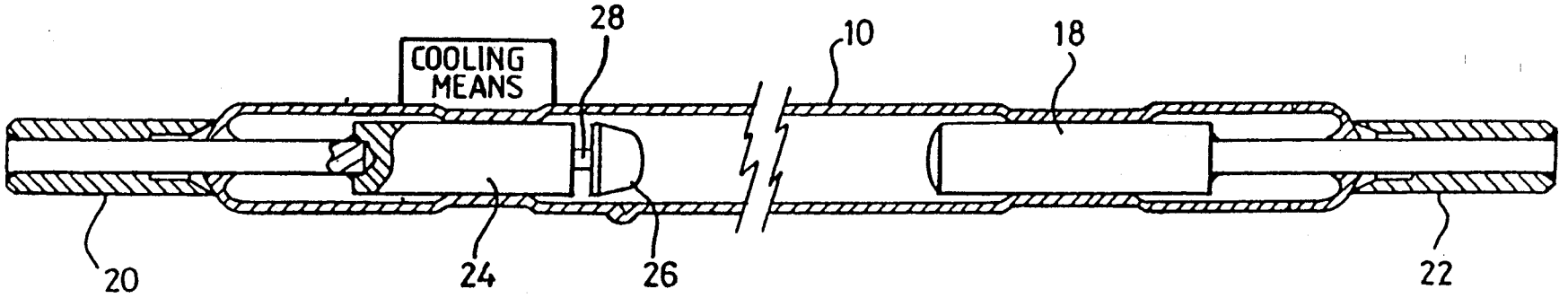
Fig. 2

PULSE SIMMER FLASH LAMP CATHODE

FIELD OF THE INVENTION

This application is a continuation of application Ser. No. 07/412,174, filed on Sep. 25, 1989, now abandoned, and which is a continuation in Part of U.S. patent application Ser. No. 07/126 491, filed on Nov. 30, 1987 now abandoned which relates to an invention which concerns flash lamps, particularly pulsed light sources and in particular but not exclusively to an improved cathode construction for use in a flash lamp which is to be capable of operating in the so-called pulse and simmer mode.

BACKGROUND TO THE INVENTION

In recent years there has come about a requirement for flash or arc lamps to operate in a mode known as "pulse and simmer" for some laser pumping applications. Such lamps consist typically of a cylindrical transparent body fitted with a metal electrode at each end. During manufacture the lamps are filled with a gas or gas mixture before final sealing.

In the pulse and simmer mode a trigger pulse is used to initiate electrical breakdown between the electrodes within the lamp. However, thereafter the plasma can be maintained as a continuous streamer within the lamp by a much lower DC voltage. This continuous DC level maintains the lamp in a "ready" condition with no further need for triggering, and is known as the simmer condition—the current flowing during this condition being referred to as the simmer current.

The lamp is then made to flash at intervals, as required by large voltage pulses, usually applied to the lamp by a separate circuit. Diodes are used to prevent the interaction of the trigger, simmer and main pulse circuits other than as described above.

Typical simmer currents are between 10mA and 5A. For a lamp with a bore of 8mm or so, a mean power level of up to 10 kW per 200mm of arc length would be expected.

In use the main pulse frequency may vary from 0.1Hz to 100 Hz. The main pulse period might then vary from some tens of milliseconds down to parts of a millisecond respectively. Main pulse currents for an 8mm bore lamp might be over 1000A for very short pulses as required in some drilling applications, or around 150A for some longer pulse welding applications, where a lower repetition rate is usually expected.

It is well known to users of conventional pulse and simmer arc lamps that, given the same mean power level, low current long period operation with long intervals between pulses results in faster failure of the lamp than high current short period high repetition rate operation. Thus laser drilling tends to give long life, whereas laser welding results in early lamp failure.

The normal failure mode of lamps of conventional construction is the obscuring of the transparent envelope by deposits from the lamp cathode. This process eventually results in the laser output dropping unacceptably. Conventional lamp cathodes are made by tipping a thoriated tungsten mount with a porous tungsten cathode impregnated with, for example Barium Calcium Aluminate. The whole structure is normally cylindrical and of a similar diameter to the lamp bore, the tipped working face generally being almost flat. The components of the electrodes are usually assembled by brazing or welding.

The tip of the cathode is very familiar as the working element of many high power vacuum valves and tubes, where loadings up to 100 A/cm$^2$ and cathode temperatures of 1500° C. might be achieved. In conventional flash lamps loadings of over 1000 A/cm$^2$ can be demanded, and in such lamps the cathode has therefore been cooled.

Degradation of the cathode has been thought to be caused by shock to and overheating of the low work function surface of the cathode. Heavy cracking of the impregnated cathode tip has usually been visible after just a few minutes operation in any high power mode, but damage is generally most severe after high power welding. Molten beads of Tungsten are apparent on the tip surface, and beads of molten metal may be visible in the bore of the lamp.

As a result, most attempts to improve these cathodes have concentrated on improved cooling, higher strength, and improved shock resistance.

Whilst the present invention has arisen in answer to a specific need for an improved pulse and simmer cathode it is believed that the improvement is equally applicable to standard pulse lamps operating with no simmer supply.

SUMMARY OF THE INVENTION

According to one aspect of the present invention there is provided a method of increasing the life of a flash lamp having a cathode and an anode in axially confronting relationship within a transparent envelope, wherein the tip of the cathode is caused to operate at an increased temperature by reducing the thermal conductivity of the mounting of the cathode tip.

According to the present invention, in another aspect, as a method of increasing the life of a flash lamp cathode, the operating temperature of the cathode is made to vary less with time when intermittently heated during pulse operation, the temperature gradient near the cathode surface is reduced, and the operating temperature of the cathode is increased. The higher operating temperature gives a more even distribution of the plasma over the cathode face.

The smaller variation in cathode temperature when used in the high power welding mode, and the reduced temperature gradient near the cathode surface leads to a smaller degree of thermal shock, and reduces the consequent damage to, and cracking of, the cathode surface. The method of attaining smaller temperature variations and gradient also causes a general increase in the cathode operating temperature.

Contrary to earlier thinking it appears that overheating of conventional cathodes is in fact caused by overstressing the cathode at local hot spots by running at too low a mean temperature, and that by deliberately raising the temperature of the cathode the plasma is more evenly distributed on the deliberately hotter cathode face.

According to another aspect of the invention there is provided a flash lamp comprising a transparent envelope, an anode and a cathode mounted in said envelope in axially confronting relationship, said cathode having a tip supported by mounting means along which in use heat is arranged to pass from the cathode, wherein said mounting means has a reduced thermal conductivity to enable the cathode tip to operate at an increased operational temperature.

In a preferred arrangement the cathode is supported in a manner which reduces the thermal conductivity away from the cathode, so reducing the cooling effect of its immediate surrounding and raising its temperature. Thus for example the cathode may be joined to its support structure via a neck of small cross-section which permits adequate electric current to flow but which reduces the flow of heat away from the cathode.

This reduced flow of heat away from the cathode prevents the cathode cooling rapidly between current pulses thus smoothing out the violent changes in temperature which can occur during pulsing.

The high thermal impedance of the small cross-section neck also isolates the cathode from the cooled part of the electrode, so that a high thermal gradient is not formed at the cathode surface, but occurs instead at the neck which is of more robust material well suited to resist the stresses so induced.

It has been found that the cathode life, even when running at the very high loadings characteristic of pulse applications generally, is greatly increased by running it under the conditions of the invention, for example at temperatures such as are employed in vacuum valves.

In the case of cathode tips secured by nickel brazing, the nickel braze sets an upper limit to the temperature in service due to the 1450° C melting point. It may be that even higher temperature operation is desirable, with a higher melting point braze alloy.

The preferred operating range is from dull red heat to the service limit of the braze alloy, currently 1400° C.

It has been noted, surprisingly, that in spite of the higher mean temperature of the cathode face, the amount of material ( especially impregnant material) lost from the tip by ablation and sublimation is greatly reduced. It is believed that the high pressures which exist within the lamp, especially during the main pulse, act to reduce the evaporation of the tip components, and that in a pulse and simmer lamp whose cathode is constructed in accordance with the present invention, loss of impregnant by evaporation from the high temperature tip face does not cause a significant problem.

In a preferred embodiment of the invention a conventional tipped cathode is undercut so that the thermal resistance between the cathode face and the rear cathode mounting is increased. The region between the undercut and the plasma is found to heat up rapidly during initial running until a steady state condition is realised.

Preferably the face of the cathode tip is generally of a mushroom shape having a diameter greater than its axial dimension. More specifically the face of the tip may be ellipsoidal with the ratio of its axial dimension to its diameter being within the range 0.3 to 0.5.

In this way the thermal conductive path to the undercut or neck portion is increased in the area around the centre of the tip face, where the emissivity would otherwise be higher. In this way the operating temperature around the face of the cathode tip is more uniform, resulting in an increase in the life of the cathode.

Figure 4:
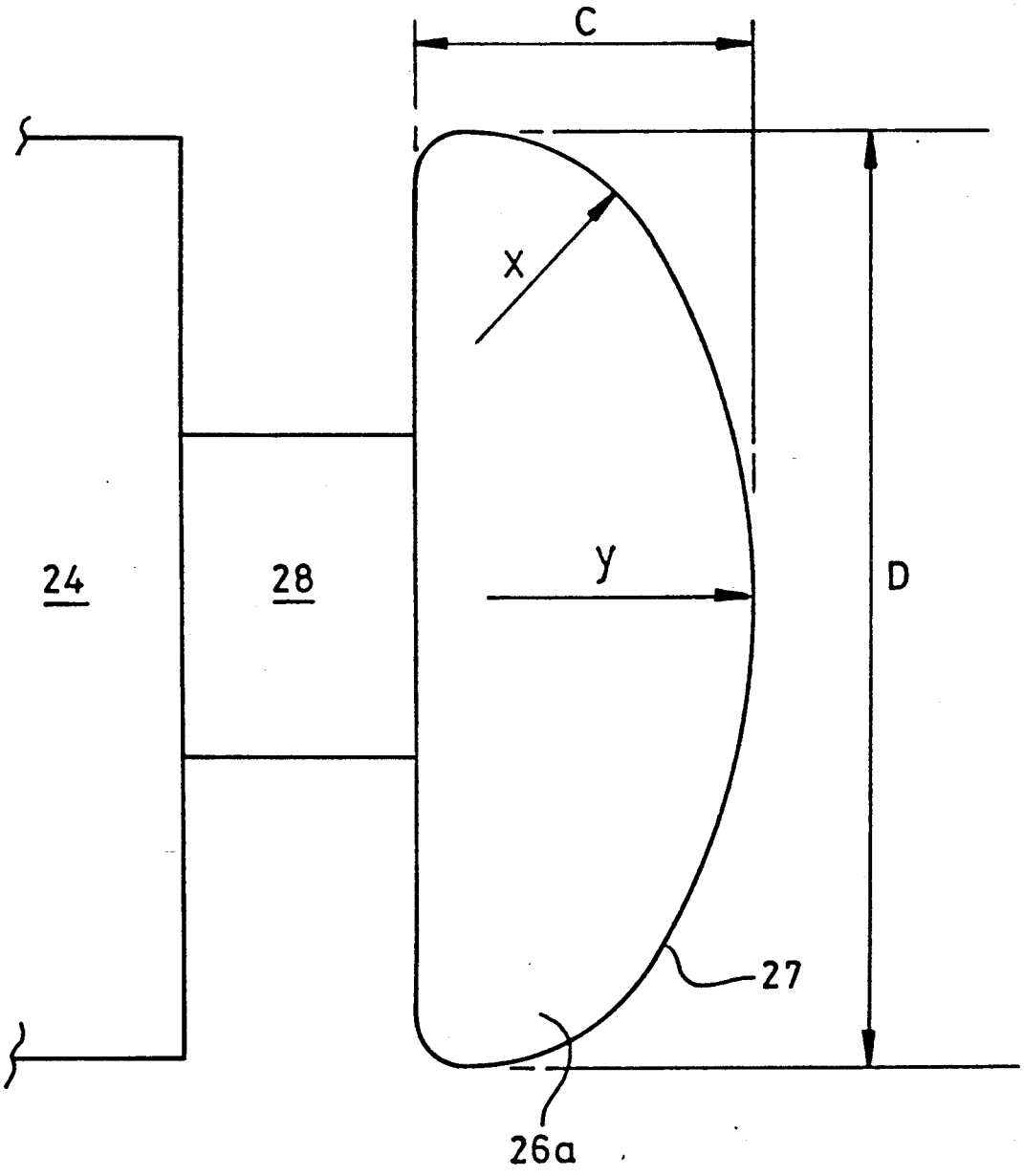

The invention will now be described by way of example with reference to the accompanying drawings, in which:

FIG. 1 side view, partially cut away, of a conventional flash lamp capable of operating in a pulse and simmer mode, FIG. 2 similar view of the lamp with the improved cathode construction of the invention, FIG. 3 is a side view of the improved cathode to a larger scale, and FIG. 4 is a side view similar to FIG. 3, showing a modified cathode.

In FIG. 1 a lamp envelope is shown at 10 with a cathode structure at the left-hand end having an impregnated tungsten tip 12, a thoriated tungsten mount 14 and a pure tungsten seal rod 16. At the other end is an anode 18. Connectors 20 and 22 allow electrical connections to be made to the anode and cathode respectively, and the large mount 14 thermally coupled to the envelope 10 allows the external cooling (not shown) of the cathode end of the envelope to conduit away any heat generated at the cathode. The rod 16 is matched by a similar rod which extends into the connector 22 at the opposite end of the lamp envelope and both rods are brazed or otherwise secured to the tungsten mount 14 and the anode 18 and to the connectors 20 and 22 respectively.

By contrast the improved cathode structure constructed in accordance with the invention comprises (as shown in FIG. 2) a mount 24 joined to a cathode tip 26 by a small cross-sectional area neck or isthmus 28. The dimensions of the neck 28 are selected so as to enable adequate current density to be achieved with minimal volt drop between its ends during pulses but the neck acting as a poor path for heat generated in the tip to be conducted away, via the mount 24, to a water cooling jacket or the like (not shown), which will normally surround the envelope in the region of the mount 24.

The average temperature of the tip 26 may be increased. The degree of temperature variation during pulsing and the thermal gradient near the cathode surface may be reduced by reducing the diameter A of the neck 28 and/or by increasing its axial length B (see FIG. 3). The region of the mount 24 is closely coupled to the water-cooled region of the lamp envelope 10 as represented generally by "cooling means" in FIG. 2, as in a conventionally constructed lamp. The tapered and radiused form of the tip 26 shown in FIG. 3 gives a transition between simmer mode and main pulse mode such that the initiation of the main arc plasma is symmetrical with respect to the axis of the lamp and is not directed against the lamp envelope 10. Some concave tip forms can give the same result. In the event of the main arc are striking against the envelope a rapid deterioration of the envelope occurs, resulting in early failure of, the lamp.

The electrical connections to the thoriated tungsten mount 24 and the anode 18 in FIG. 2 are similar to those of FIG. 1, and reference is made to the description of FIG. 1 in this regard.

Referring now to FIG. 4, there is shown a modified cathode tip **26*a* having generally a mushroom shape. This is generated as a surface of revolution by a generally elliptical curve 27 formed by blending two arcs of radii x and y. The size of the radii x and y for such and ellipsoidal shape are so chosen that the ratio of the axial length C of the tip 26*a* (up to the neck 28**) to its diameter D is approximately 0.4. However it is believed that suitable ratios would also be in the range 0.3 to 0.5.

Such a tip does not suffer from a high emissivity concentrated at the centre of the cathode face over a circular area of about 1.5 to 3mm, which would otherwise cause this area to operate at a hotter temperature than the outer parts of the cathode face, resulting in a decrease in the useful working life of the cathode. In operation of the cathode of FIG. 4 the heat will be dissipated more quickly at the centre than at the outer parts, where the thermal conductive path is longer, thus promoting a more uniform temperature over the active surface of the cathode and giving rise to a larger emissive area. Consequently the useful working life of the cathode is believed to be substantially extended.

We claim:

1. A pulsed flash lamp designed to operate in a pulse and simmer mode comprising:

a transparent envelope;

an anode and cathode mounted in said envelope in an axially confronting relationship said cathode comprising mounting means of an electrical and heat conductive material, and an electrically conductive tip;

a cooling means provided for cooling said cathode; and means for providing a pulsed electrical current to said cathode;

wherein said mounting means includes a neck portion of a reduced cross-section to support the relatively large cathode tip whereby the neck serves to reduce the thermal conductivity of said mounting means to enable the cathode to operate at an increased operational temperature, and wherein said cooling means is thermally coupled to said mounting means;

2. A flash lamp according to claim 1 in which the cathode tip directed is generally of a mushroom shape having a diameter greater than its axial dimension from said neck portion.

3. A flash lamp according to claim 1 in which said thermal conductivity is reduced by increasing the length of said neck portion.

4. A flash lamp according to claim 3 in which the face of the cathode tip directed towards said anode is generally ellipsoidal and the ratio of its diameter to its axial dimension is within the range 0.3 to 0.5.

5. A flash lamp according to claim 1 in which the cathode tip operates at a temperature in the order of 1,400° C.

6. A flash lamp according to claim 1 in which said cathode tip is made of tungsten, mounting means is made of a thorated tungsten.

7. A pulsed flash lamp designed to operate in a pulse and simmer mode comprising:

a transparent envelope;

an anode and cathode mounted in said envelope in an axially confronting relationship;

mounting means for mounting a tip of said cathode and for providing controlled cooling of said tip such that temperature variation of the tip during pulsing is reduced and excessively high temperatures are avoided, said mounting means including a cathode mount and a neck of reduced cross-section, said neck extending from said cathode mount to said tip and providing a reduced thermal conductivity portion of the mounting means to prevent rapid dissipation of heat from said tip through said neck and thereby reducing temperature variation of the tip during pulsing;

cooling means termally coupled to said cathode mount to remove heat from the cathode thereby avoiding excessive heating of said cathode while preventing large temperature variation and large temperature gradients in the tip during pulsing as a result of the reduced thermal conductivity neck extending between the cooled cathode mount and the tip.

8. A method according to claim 7 which the operating temperature of the cathode tip is in the order or 1,400° C.

9. The pulsed flash lamp of claim 7, wherein said cathode mount has a cross-section which is substantially larger than the cross-section of the neck.

10. The pulsed flash lamp of claim 7, wherein the cathode tip is generally of a mushroom shape.

11. The pulsed flash lamp of claim 7, wherein the cathode tip directed towards said anode has a ratio of its diameter to its axial length in the range of 0.3 to 0.5.

12. The pulsed flash lamp of claim 7, wherein the cathode tip includes tungsten, and the mounting means includes thorated tungsten.

* * * * *